US006949149B2

(12) United States Patent
Zelin et al.

(10) Patent No.: US 6,949,149 B2
(45) Date of Patent: Sep. 27, 2005

(54) HIGH STRENGTH, HIGH CARBON STEEL WIRE

(75) Inventors: Michael Gregory Zelin, Canal Fulton, OH (US); Thomas Walter Starinshak, Wadsworth, OH (US); James Terry Lewis, Cuyahoga Falls, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 206 days.

(21) Appl. No.: 10/322,975

(22) Filed: Dec. 18, 2002

(65) Prior Publication Data

US 2004/0118486 A1 Jun. 24, 2004

(51) Int. Cl.[7] ..... C22C 38/32; C21D 8/06

(52) U.S. Cl. ..... 148/333; 148/330; 148/595; 148/598; 148/599

(58) Field of Search ..... 148/595, 598, 148/599, 330, 333, 530, 532, 537

(56) References Cited

U.S. PATENT DOCUMENTS

| | | | | |
|---|---|---|---|---|
| 4,046,600 | A | 9/1977 | Yamakoshi et al. | 148/12.4 |
| 4,795,609 | A | 1/1989 | Saka et al. | 420/109 |
| 4,842,818 | A | 6/1989 | Kato et al. | 420/100 |
| 4,854,032 | A | 8/1989 | Dambre | 29/527 |
| 5,211,772 | A | 5/1993 | Ashida et al. | 148/336 |
| 5,240,520 | A | 8/1993 | Tarni et al. | 148/532 |
| 5,248,353 | A | 9/1993 | Nishida et al. | 148/598 |
| 5,261,974 | A | 11/1993 | Hyodo et al. | 148/320 |
| 5,535,612 | A | 7/1996 | Vijayakar | 72/43 |
| 5,603,208 | A | 2/1997 | Fujita et al. | 57/200 |
| 5,609,013 | A | 3/1997 | Kaaneda et al. | 57/200 |
| 5,749,981 | A | 5/1998 | Tonteling et al. | 148/595 |
| 5,822,973 | A | 10/1998 | Kaneko et al. | 57/902 |
| 5,873,961 | A | 2/1999 | Bhagwat et al. | 148/595 |
| 5,888,321 | A | 3/1999 | Kazama et al. | 152/451 |
| 5,956,935 | A | 9/1999 | Katayama et al. | 57/902 |
| 6,048,416 | A | 4/2000 | Hauser et al. | 148/500 |
| 6,099,797 | A | 8/2000 | Bhagwat et al. | 420/91 |
| 6,322,641 | B1 | 11/2001 | Makii et al. | 148/330 |
| 6,402,858 | B1 | 6/2002 | Ishizaka | 148/333 |
| 6,418,994 | B1 | 7/2002 | Arnaud et al. | 152/556 |
| 6,530,410 | B1 | 3/2003 | Obana | 152/527 |

FOREIGN PATENT DOCUMENTS

| | | | |
|---|---|---|---|
| EP | 0708182 | 4/1996 | C22C/38/42 |
| EP | 1069199 | 1/2001 | C22C/38/00 |
| EP | 1293582 | 3/2003 | C22C/38/00 |
| JP | 4254526 | 2/1991 | C21D/9/52 |
| JP | 92638887 | 3/1996 | C22C/38/00 |
| JP | 2001279382 | 10/2001 | C22C/38/00 |
| JP | 2001234286 | 8/2002 | C22C/38/00 |

*Primary Examiner*—Deborah Yee
(74) *Attorney, Agent, or Firm*—Nancy T. Krawczyk

(57) ABSTRACT

To achieve a drawn wire with a tensile strength defined by the equation of $Y=Y_o \exp(A_2\epsilon_d)$ wherein Y is the tensile strength in MPa ($N/mm^2$), $Y_o$ is the strength of as patented wire, $A_2$ is a coefficient dependant on wire chemistry and drawing conditions, and $\epsilon_d$ is a total true drawing strain, a high carbon steel wire contains 0.95 to 1.3% carbon and a combination of chromium, manganese, silicon, cobalt, niobium, and boron is processed such that the bright wire of an intermediate diameter has a structure void of micro cracks, patented to produce a desired microstructure with defined inter-lamella spacing and austenite grain, coated with brass, and fine drawn with an optimized die draft schedule at a specified true strain.

15 Claims, 6 Drawing Sheets

HIGH STRENGTH, HIGH CARBON STEEL WIRE

FIELD OF THE INVENTION

The present invention is directed to a high strength steel wire and a method of manufacturing of such a wire. Specifically, the wire has a composition and is manufactured in a defined process resulting in a wire with a tensile strength greater than 3800 MPa at wire diameters of 0.2 to 0.4 mm, preferably greater than 4500 MPa.

BACKGROUND OF THE INVENTION

It is frequently desirable to reinforce rubber articles (such as, tires, conveyor belts, power transmission belts, timing belts and hoses) by incorporating therein steel reinforcing elements. Pneumatic vehicle tires are often reinforced with cords prepared from brass-coated steel filaments. Such tire cords are frequently composed of high carbon steel or high carbon steel coated with a thin layer of brass. Such a tire cord can be a monofilament, but normally is prepared from several filaments that are stranded together. In most instances, depending upon the type of tire being reinforced, the strands of filaments are further cabled to form the tire cord. It is important for the steel alloy utilized in filaments for reinforcing elements to exhibit high strength and ductility as well as high fatigue resistance.

Transformation of the steel alloy into a filament suitable for reinforcing rubber articles involves multiple processing stages, including rough drawing, patenting, brass plating and fine drawing. The selected process to achieve a steel wire with defined characteristics can include many variations on those processing stages, including repeating the different stages.

Drawing of the wire reduces it from an original diameter to a smaller diameter by passing the wire through a conical die. Drawing of the wire increases the strength characteristics of the metal. Cold drawing can be done by using either wet or dry lubricants. Formation of a wire with desired properties may include multiple drawing steps both prior to and after patenting of the wire.

The object of patenting is to obtain a structure which combines high tensile strength with high ductility, and thus impart to the wire the ability to withstand a large reduction in area to produce the desired finished sizes possessing a combination of high tensile strength and good toughness. Patenting is normally conducted as a continuous process and typically consists of first heating the alloy to a temperature within the range of about 900° C. to about 1150° C. to form austenite, and then cooling at a rapid rate to a lower temperature at which transformation occurs which changes the crystal structure of ferrite from face centered cubic into pearlite, an eutectoid mixture of ferrite and cementite, which yields the desired mechanical properties. In many cases, while it is desired to form a fully pearlitic structure, additional phases can be present, such as undissolved carbides, pro-eutectoid cementite, and bainite.

For tire reinforcements, the continual goal is to increase the strength of the wire without a loss in ductility and fatigue resistance. In this quest for improved wire characteristics, the resulting wires have been characterized depending on the tensile strength by using different identifiers such as high tensile, super tensile, ultra tensile strength, and mega tensile wherein each wire strength is defined by a minimum tensile strength.

SUMMARY OF THE INVENTION

The present invention discloses high carbon steel alloys that can be drawn into filaments having a diameter of about 0.35 mm which posses a tensile strength of at least 3800 MPa, a high level of ductility and outstanding fatigue resistance. Filaments with smaller diameters, for instance, having a diameter of 0.2 mm, made with the alloys and processing technique of this invention have a tensile strength greater than 4200 MPa, preferably greater than 4500 MPa.

Disclosed is a process for forming a Mega Tensile (MT) strength wire. The process is characterized by these steps: selection of a steel composition, rough drawing to an intermediate bright wire size, patenting, brass coating, and fine drawing. After the selection of a composition, the steel is cast and hot rolled to an initial rod diameter, which is typically around 5.5 mm. Rough drawing reduces the diameter to an intermediate bright wire diameter. Patenting and brass plating improves wire drawability. Additionally, the surface brass layer ensures a good drawability, wire adhesion to the rubber, and steel corrosion properties. The fine drawing reduces the wire to a final diameter and final, desired physical properties.

The wire has the following composition in percents by weight: $0.95\% \leqq \text{Carbon} \leqq 1.3\%$, $0.2\% \leqq \text{chromium} \leqq 1.8\%$, $0.2\% \leqq \text{manganese} \leqq 0.8\%$, $0.2\% \leqq \text{silicon} \leqq 1.2\%$, cobalt$\leqq$2.2%, niobium$\leqq$0.1%, and 0.0006 parts per million (ppm)$\leqq$boron$\leqq$0.0025 ppm.

It is disclosed that the rough drawing of the rod to reduce the diameter of the cast wire to an intermediate bright wire diameter is accomplished preferably by using a non-linear tapered draw. The rough draw with a total true drawing strain of more than 1.5, termed direct drawing, is preferably accomplished by using a dry draw lubricant. The drawing is preferably accomplished at a rate of no more than 14 m/sec.

Patenting of the wire can take place by numerous types of processing routes, but in all cases austentization and transformation process are included. In the disclosed invention, the wire properties has particular properties after patenting. The steel is characterized by a fine grained pearlitic microstructure with a small interlamellar spacing. The presence of undesirable microstructural components, such as undissolved carbides and free ferrite, is limited or eliminated. The network of pro-eutectoid cementite formed around the pearlite has a thickness of not more than 20 nm.

The strength of the wire after patenting, required to achieve the final high strength filament, is determined by the following equation:

$$Y_0 = A_1[(1-C/C_c)(Y_f+K_f/((1-C/C_c)L)^{0.5}+(Y_c+K_c/(C/C_c\,L)^{0.5}C]+H\epsilon$$

where: $A_1$=a constant varying from 0.1 to 1 depending on the content of the alloying elements, C=the carbon content of the steel, in %, $C_c$=the carbon content in cementite, in %, L=the thickness of ferrite lamellae, $Y_f$, $K_f$ and $Y_c$, $K_c$=Hall-Petch constants for ferrite and cementite, respectively, H=the strain hardening of the wire, and $\epsilon$=the total elongation of the wire.

Patenting conditions are chosen to achieve an elongation $\epsilon$ of the wire, at that stage of processing, of at least 7.5% and a tensile strength of at least 1400 MPa.

In one disclosed aspect of the invention, patenting of the wire occurs by first passing the wire through at least two different temperature sections in austenitization zone. The wire is then rapidly cooled to a transformation temperature below the ideal transformation temperature. The transformation temperature is about 20° to about 80° C. below the ideal temperature wherein the ideal temperature is defined as the shortest time it takes for the wire to begin pearlitic transformation. The wire is transformed by passing the wire through at least two different temperature zones wherein the wire is maintained at the transformation temperature.

Also disclosed is brass plating of the wire wherein a brass layer is deposited on the wire after patenting. Thickness of the deposited layer is chosen based on the total drawing strain in fine drawing to obtain a brass surface layer in a drawn filament with a thickness of approximately 0.2 $\mu$m and upward on.

The fine drawing of the wire reduces the wire to a final diameter of about 0.1 to about 0.4 mm at a specific true strain level.

In one aspect of the invention, the final strength of the wire is determined by the following equation, and is based on the intermediate strength of the wire:

$$Y=Y_o \exp(A_2\epsilon_d)$$

where: Y=the tensile strength, MPa (N/mm$^2$), $Y_o$=the tensile strength as determined by the tensile strength equation for the intermediate patented wire, MPa, $A_2$=coefficient dependant on wire chemistry and drawing conditions, and $\epsilon_d$=the total true drawing strain.

In another aspect of the invention, after both the rough drawing and the fine drawing, a skin pass is performed on the wire to reduce wire delamination under both bending and torsion loading. This is also termed a double-die in which the total reduction is split by two dies with the last die having about a 4% reduction.

Also disclosed is a wire made by the disclosed process, and products incorporating the wire made by the disclosed process.

Definitions

The following definitions are applicable to the present invention:

"High Tensile Strength Steel (HT)" means a carbon steel with a tensile strength of at least 3400 MPa@0.20 mm filament diameter;

"Super Tensile Strength Steel (ST)" means a carbon steel with a tensile strength of at least 3650 MPa@0.20 mm filament diameter;

"Ultra Tensile Strength Steel (UT)" means a carbon steel with a tensile strength of at least 4000 MPa@0.20 mm filament diameter; and "Mega Tensile Strength Steel" means a carbon steel with a tensile strength of at least 4500 MPa@0.20 mm filament diameter.

BRIEF DESCRIPTION OF THE DRAWINGS

The invention will be described by way of example and with reference to the accompanying drawings in which.

DETAILED DESCRIPTION OF THE INVENTION

The present invention is directed to a high tensile strength steel wire and a method of manufacturing such a wire. The ultimate tensile strength of the wire is a function of its carbon content, the microstructure achieved during patenting of the wire, determining its original strength, and a precise calculation of the appropriate drawing strain to which the wire is subjected. The wire has a tensile strength defined by the following Equation 1:

$$Y=Y_o\exp(A_2\epsilon_d) \qquad \text{EQ. 1}$$

where: Y=the tensile strength, MPa (N/mm$^2$), $Y_o$=the tensile strength as determined by the tensile strength equation for the intermediate patented wire, MPa, $A_2$=coefficient dependant on wire chemistry and drawing conditions, and $\epsilon_d$=the total true drawing strain.

Figure 1:
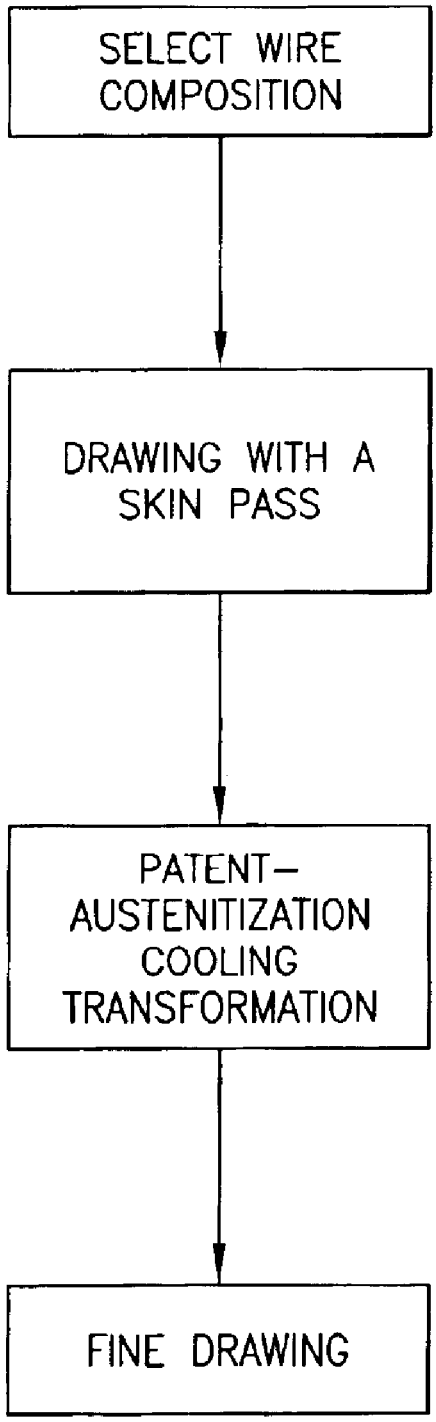
FIG. 1 is a flowchart of the manufacturing process according to the invention.

The method of achieving the wire having the desired physical properties is outlined in the flowchart of FIG. 1.

Wire Composition

To achieve the desired property of the steel, the chemical composition of the steel is as described below.

Carbon, C, is present in the amount of 0.95 to 1.3%. Because of the carbon content, the mega tensile steel is considered a high carbon steel. Carbon is the main strengthening element. Steel with carbon content of 0.95 to 1.05% can be processed to have a fine pearlitic structure characterized by a good combination of high ductility and strength. When the carbon content is greater than 1.05%, there is formation of cementite networks around blocks of pearlite colonies. The increased carbon results in a higher volume fraction of cementite leading to increased strength of steel, but dramatically reduces local ductility of the wire because broken cementite networks can cause crack formation. For this reason, high carbon steel has severe limitations in wire drawing processability. However, the characteristics of the steel can be controlled by a defined chemical composition and processing to provide a high strength wire with ductility sufficient for wire drawing without resulting in premature breaks. As will be discussed later, a high carbon wire can be processed according to the present invention to have ductile properties similar to a 0.96% C steel with improved strength.

Chromium, Cr, is present in amounts of 0.2 to 1.8%. Cr reduces the carbon diffusion rate resulting in both refining of the pearlite and reducing the thickness of the pro-eutectoid cementite network during patenting. The Cr partitions into cementite, affective the cementite crystal structure, thereby reducing the cementite brittleness. If the amount of Cr is less than 0.2% the addition induces a poor effect. Conversely, if the amount of Cr is greater than 1.8%, hardenability becomes high and martensite or bainite is formed during patenting, resulting in deterioration of cold workability.

Manganese, Mn, is present in amounts of 0.2 to 0.8%. Mn is added because it is a strong solid solution strengthener of ferrite. When the Mn content is less than 0.2%, the strengthening effect is not achieved, and when the Mn content is in excess of 0.8%, there is a deterioration of cold workability, particularly, due to a higher number of Mn—S inclusions.

Silicon, Si, is present in amounts of 0.2 to 1.2%. Si is also added due to its ability to impart a strong solid solution strengthening on ferrite. When the Si content is less than 0.2%, the effect is lost, and when the Si content is greater than 1.2% than silicate inclusions can form increasing the probability of wire breakage during drawing.

Cobalt, Co, if present, then there is no more than 2.2%. Co suppresses the formation of cementite networks in the high carbon steel when the carbon content is greater than 1.0% of the steel. If the amount of Co is greater than 2.2%, than cobalt inclusions are formed, negatively affecting wire drawability. Another consideration is the additional cost associated with using Co in such steel.

Niobium, Nb, if present, is present in amounts of not more than 0.1% and is preferably present when forming high carbon steel with a carbon content greater than 1.0%. The small amount of Nb controls the size of pearlite colonies through limiting growth of austenite grains at the austenitization stage of patenting and prevents formation of large particles that can result in wire breaks during drawing. Small Nb precipitates pin austenite grain boundaries preventing excessive austenite grain growth, thereby improving wire ductility.

Boron, B, is present in amounts of 0.006–0.0025 parts per million (ppm). The small amount of B primarily affects the structure of crystalline interfaces. During wire drawing, the volume fraction of ferrite/cementite interlamellar interfaces can increase up to ten percent. Boron atoms are known to segregate at grain boundaries, thereby eliminating de-cohesion. Additionally, boron ties free nitrogen, thereby reducing strain aging during drawing and improving wire ductility.

Exemplary compositions for the wire within the scope of the present invention, as well as a conventional wire, are set forth below in Table 1.

TABLE 1

Steel Wire Compositions

| | Comparison | A | B | C |
|---|---|---|---|---|
| C, % | 0.80 | 0.96 | 1.04 | 1.10 |
| Cr, % | 0.04 | 0.20 | 0.5 | 0.5 |
| Mn, % | 0.6 | 0.6 | 0.6 | 0.6 |
| Si, % | 0.4 | 0.4 | 0.4 | 0.4 |
| Co, % | — | | 1.8 | 1.9 |
| Nb, % | — | | 0.006 | 0.006 |
| B, ppm | — | .0016 | 0.0006 | 0.0006 |

Figure 2:
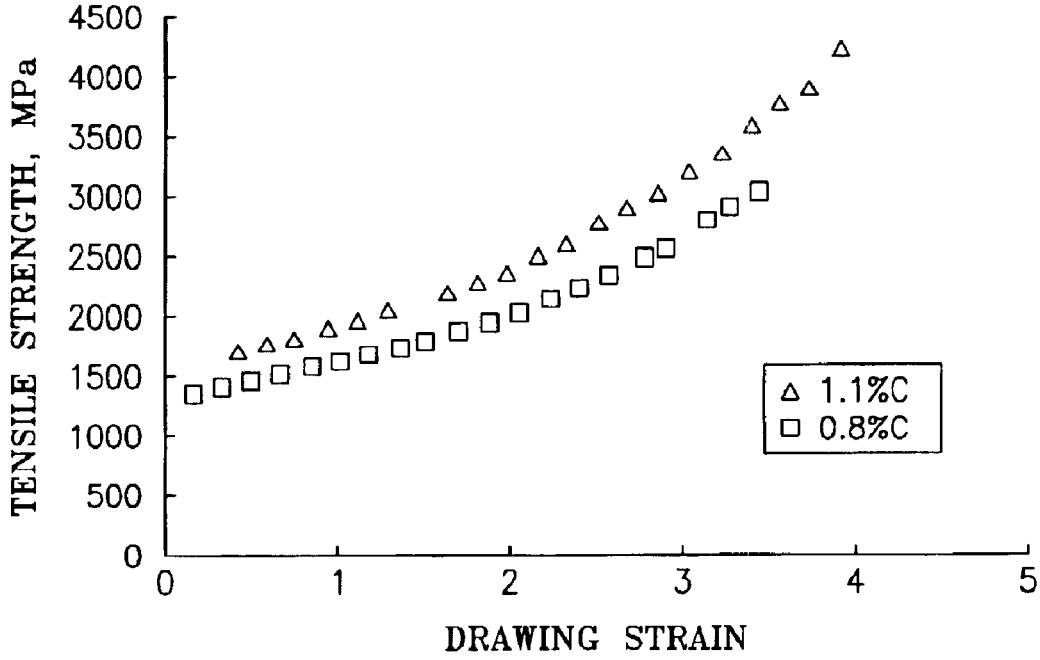
FIG. 2 is a graph showing the dependence of the tensile strength as a function of drawing strain

FIG. 2 is a graph showing the relationship between the tensile strength and the drawing strain of wires that were produced by the route indicated in FIG. 1. The upper curve represents steel with a carbon content of 1.1%, and the lower curve represents steel with a carbon content of 0.8%. The tensile strength for the 1.1% carbon content steel is greater, and the tensile strength increases more rapidly than for the 0.8% carbon content steel as the drawing strain is increased.

After the desired wire composition is achieved, the steel is hot rolled to form wires with an initial diameter of about 4.0 to about 5.5 mm, the wire is preferred to be direct drawn for an initial diameter reduction, patented to the tensile strength desired, as will be discussed further below, brass plated, and then fine drawn to reduce the wire to a final diameter of about 0.1 to 0.35 mm and a tensile strength defined by Equation 1.

The hot rolled steel is preferably free of centerline carbon segregation with non-deformable inclusions having a size not more than 10 microns. The network of pro-eutectoid cementite, if present, has a thickness of not more than 20 nm.

The process for each of the stages to which the steel is subjected is described below.

Rough Rod Drawing to Bright Wire

After the steel is hot rolled to an initial wire diameter of about 4.0 to about 5.5 mm, the wire is subjected to a direct draw. During the direct draw, by using a dry drawing lubricant at a drawing rate up to 14 m/sec, the wire diameter is reduced to about 1.1 mm to about 2.0 mm. The drawing is accomplished by using a non-linear tapered draft wherein, by using a series of dies, the diameter of the wire is gradually reduced.

The non-linear tapered draft is designed to avoid wire overheating and obtain a more uniform die wear and is designed for each wire based upon the wire strength. During wire drawing, pearlite interlamellar spacing decreases leading to the higher wire strength.

Figure 3:
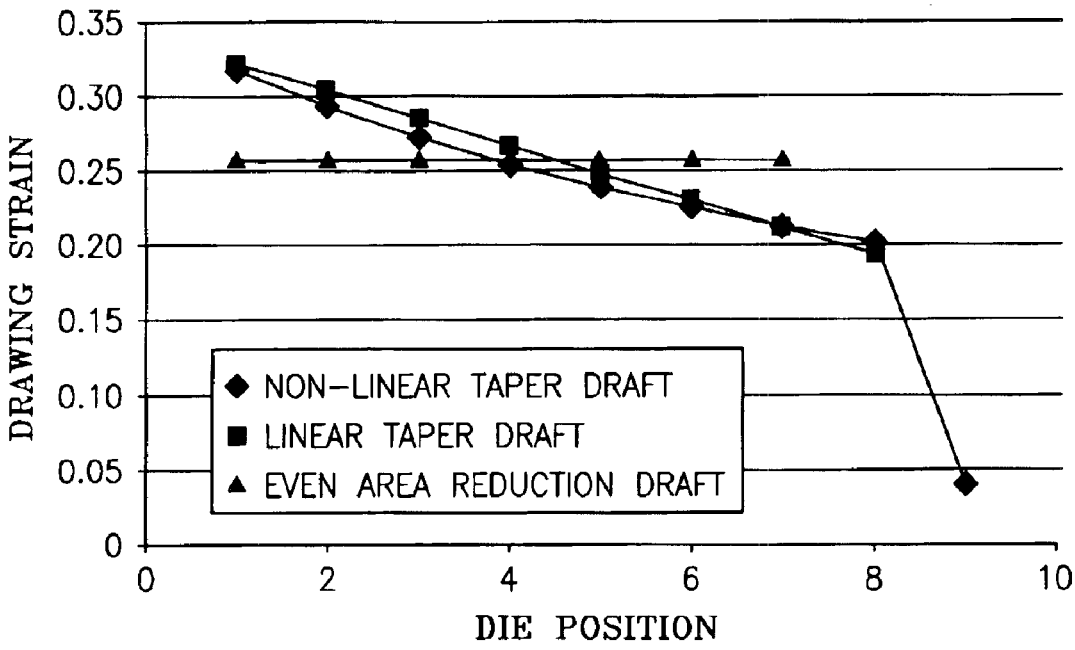
FIG. 3 is a comparison of drafts for rough drawing, including the non-linear tapered draft of the present invention.

As the wire passes through the non-linear tapered draft, the reduction in diameter is greater when the steel is soft and has a relatively high ductility and the reduction in diameter at the final stages of the drawing process is relatively smaller than at the beginning of the drawing process, see FIG. 3. The non-linear tapered draft reduces wire overheating thereby eliminating strain aging during wire drawing and reducing die wear. This process also improves wire drawability and reduces the probability of micro-crack formations in the bright wire. In the non-linear taper draft of FIG. 3, the last step is a skin pass, discussed below.

The process uses the direct drawing as opposed to conventional drawing process with intermediate patenting. The use of the non-linear tapered draft improves wire processability, avoiding the need for an intermediate patenting process, thereby increasing processing efficiency and reducing wire manufacturing time.

Following the direct draw, the wire is subject to a skin pass wherein the diameter of the wire is reduced by approximately 4%. This limited reduction in diameter incorporated into the die line-up for the direct drawing reduces wire delamination, i.e. axial cracking of the wire under torsion load.

The above is the preferred process, but rough drawing, intermediate patenting, and intermediate drawing by using conventional even area reduction drafts is an alternative, but time consuming, path that can be employed by those skilled in the art to obtain the needed wire properties as defined above. The skin pass can also be incorporated in these alternative less efficient high strength wire manufacturing processes with positive effect on wire properties. What is important is the wire properties derived when using the specified rod.

Patenting

During patenting of the wire, the goal is to improve the ductility of the wire and provide a microstructure capable of yielding the target strength sought from the wire. The patenting has three distinct steps: austenitization, cooling, and transformation.

Austenitization

During austenitization, the drawn wire is quickly heated to an initial high temperature within the range of 930° to about 1100° C. It has been found that if the furnace temperature in the first furnace section is about 50 to 100° C. higher than the targeted austenitization temperature, the wire can be heated faster to the desirable temperature. After the wire is heated to the initial high temperature, the wire passes into at least one lower temperature furnace section to maintain a desired wire temperature. Temperature in the remaining furnace zones gradually tapers down to the target austenitization temperature in the last zone.

It is important that the wire be given sufficient time for the alloy to be fully austenitized as it passes through the different heating sections; however, the wire should not be subjected to an excessive heating period. The goal is to obtain small austenite grain size, preferably not more than 50 microns. Along with the reduced heating time improving process efficiency, the temperature gradient experienced by the wire results in a formation of a fine grained austenite microstructure yielding improved ductility characteristics of the patented wire. Heating of the wire can be accomplished by electric resistance, fluidized bed, or electric or gas fired furnace. The time in each furnace will depend on its length and wire speed.

Cooling

After passing through the heated zones, as described above, the wire is rapidly cooled to a temperature below the ideal transformation temperature. Typical transformation temperatures range from 525° to 620° C., depending on the content of the alloying elements. For the exact alloy composition being worked, on a temperature time transformation (TTT) diagram, see FIG. 4, there is an ideal temperature T1 corresponding to the nose of the TTT diagram, i.e. the shortest time for pearlitic transformation to begin. The wire is cooled to a temperature Tt about 20° to 80° C. below the ideal temperature T1. This lower temperature Tt than becomes the transformation temperature of the wire being worked.

Figure 5:
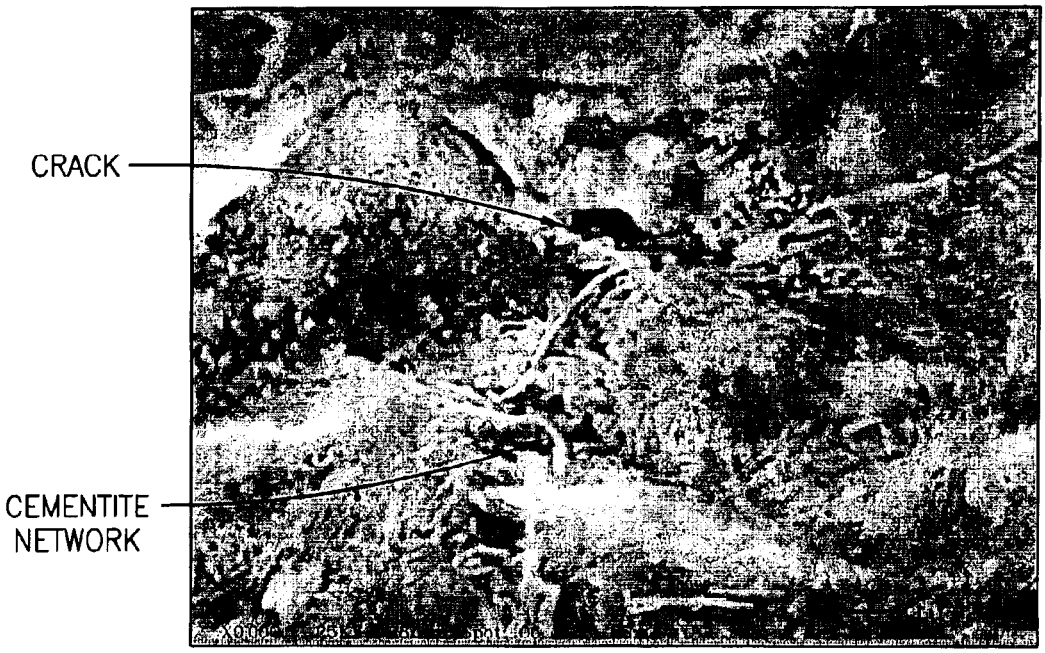
FIG. 5 is a photo showing a cementite network broken during wire formation.
Figure 6:
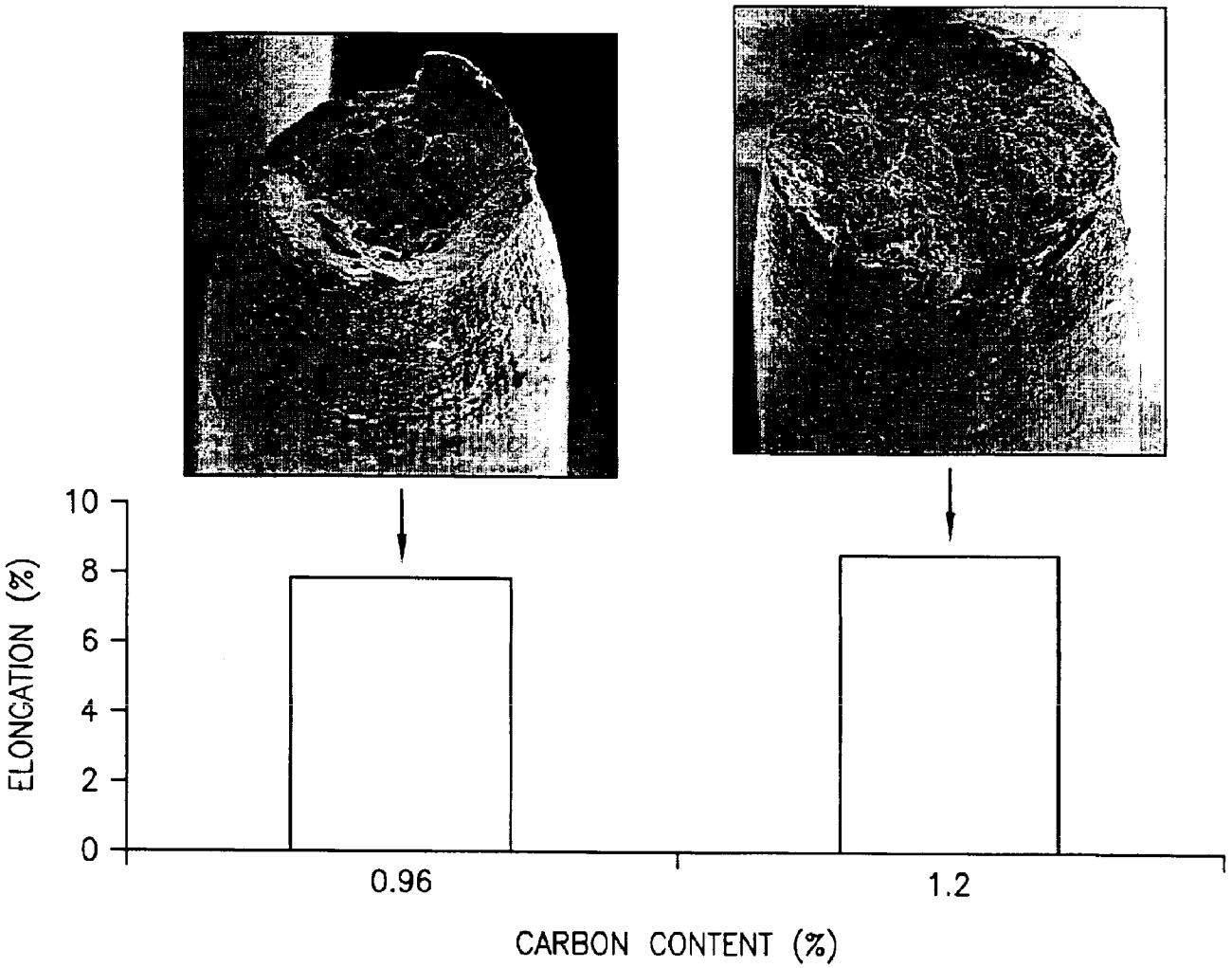
FIG. 6 shows a comparison of necking of two steel compositions.

The wire is cooled at a rate higher than 30 C. per second, preferably 50 C. per second. The wire is preferably cooled to the desired temperature within a period of 4 seconds or less. By quickly quenching the wire to a lower temperature, formation of a thick network of pro-eutectoid cementite is suppressed, improving the wire's ductility. FIG. 5 shows that a thick network of pro-eutectoid cementite breaks during wire drawing, negatively impacting wire drawability. However, a thin network of pro-eutectoid cementite with a thickness less than 20 nm can act as a reinforcement in pearlite increasing resistance to strain localization. FIG. 6 illustrates an increased resistance to neck formation of a steel wire with a network of pro-eutectoid cementite as compared with that of a wire with a pearlitic structure. This resistance to necking under tension increases breaking load and improves overall tensile ductility.

Transformation

After the wire is rapidly cooled to the transformation temperature, similar to the austenitization phase, the wire passes through preferably multiple, different temperature heat zones. The temperature in the first zone is set to maintain the wire temperature at the transformation temperature Tt. The second temperature zone is 10° to 20° C. less than the prior zone to compensate for heat generated by the wire as transformation from the austenite phase to the pearlite phase progresses to prevent the wire from overheating. The time in the second zone is approximately half of the total holding time for the wire to transform; total time is dependent upon the length of time for the wire to achieve full transformation and this is dependent upon the exact wire composition.

Figure 4:
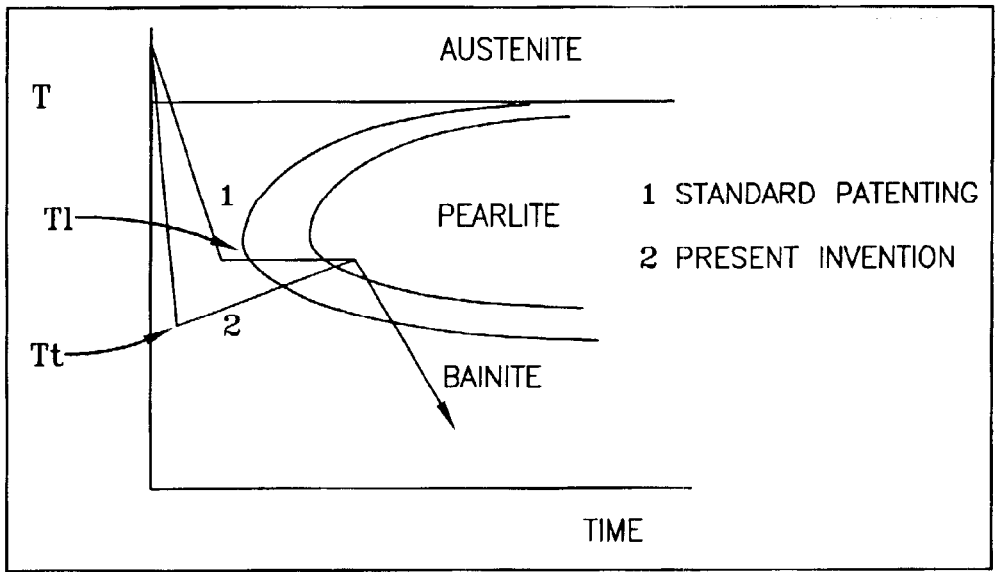
FIG. 4 is a schematic transformation temperature time diagram.

FIG. 4 also shows the temperature path of conventional metal working. Path 1 is the temperature path of a standard patenting method wherein the wire is cooled to just below T1 and the temperature of the wire maintains the same temperature as the wire transforms from bainite to pearlite. Path 2 shows the temperature path used by the present invention as described above.

By employing a temperature gradient at this stage of wire formation, the latent heat released results in fine pearlitic microstructure with an interlamellar spacing of less than 60 nm, thereby improving strength characteristics of the wire. After the transformation is fully completed, the wire is cooled to ambient temperature.

The patenting described above describes a gas fired or fluidized bed furnace with fluidized bed quench and transformation being present. Patenting by the continuous cooling transformation would not be a viable route for the rod alloys listed. Lead patenting is the process by which after austenitization the wire is rapidly submerged in molten lead at a prescribed transformation temperature. Alternatively, the lead bath can be replaced with a polymer solution, salt bath, oil, or other common quenching solutions that provides sufficient cooling. The lead patenting and alternative routes can also produce wire with suitable microstructure for future processing, but it is not as ideal as the process described above. In all cases, the wire should not be subjected to an excessive heating period so that the pearlite globular size determined by the austenite grain size is not excessive, preferably not more than 50 microns and fine pearlitic microstructure with interlamellar spacing of less than 60 nm.

After patenting, the steel wire has desired properties that enable the final tensile strength to be achieved. The steel is characterized by the fine grained microstructure with a small interlamellar pearlite spacing of the dimensions stated above. The presence of undesirable microstructural components, such as undissolved carbides and free ferrite, is limited or eliminated. The network of pro-eutectoid cementite formed around the pearlite has a thickness of not more than 20 nm. Strength of the patented wire required to achieve the high strength filament is determined by the following Equation 2:

$$Y_0=A_1[(1-C/C_c)(Y_f+K_f/((1-C/C_c)L)^{0.5}+(Y_c+K_c/(C/C_cL)^{0.5}C]+H\epsilon \quad \text{EQ. 2}$$

where: $A_1$=a constant varying from 0.1 to 1 depending on the content of the alloying elements, C=the carbon content of the steel, in %, $C_c$=the carbon content in cementite, in %, L=the thickness of ferrite lamellae, $Y_f$, $K_f$ and $Y_c$, $K_c$=Hall-Petch constants for ferrite and cementite, respectively H=the strain hardening of the wire, and $\epsilon$=the total elongation of the wire.

Patenting conditions are chosen to achieve an elongation $\epsilon$ of the wire, at that stage of processing, of at least 7.5% and a tensile strength of at least 1400 MPa.

Fine Drawing

Figure 7:
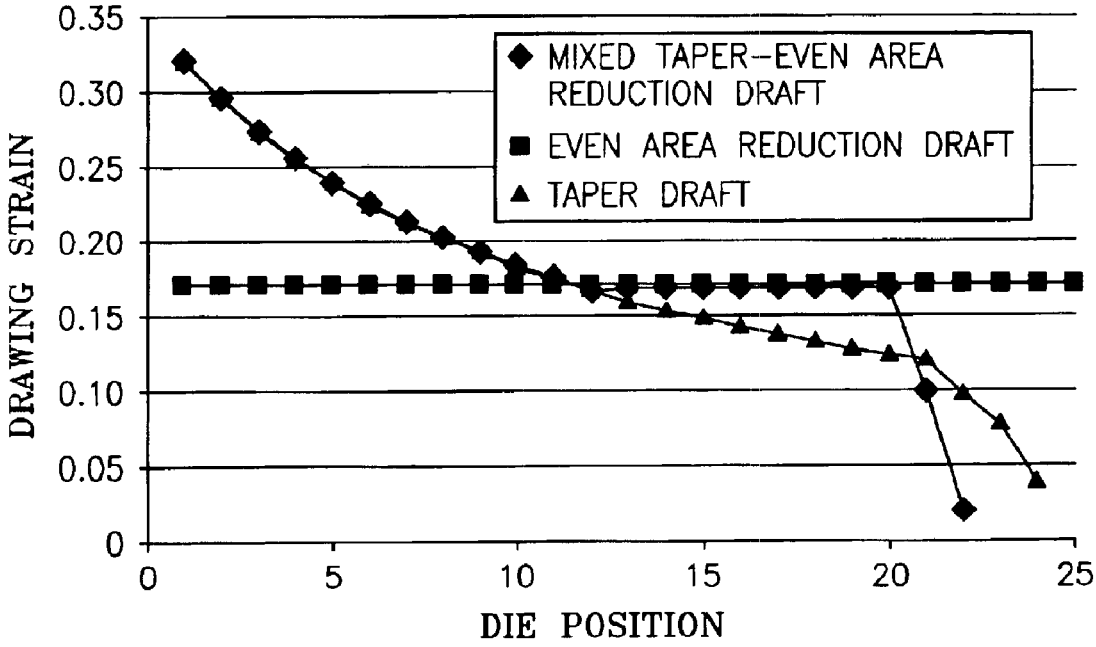
FIG. 7 is a comparison of drafts for fine drawing.

During the fine draw stage, a tapered draft or a mixed tapered-even area reduction draft is employed. FIG. 7 shows the drawing strain the wire is subjected to during the drawing when a tapered draft or a mixed tapered-even area reduction draft is used. Also shown is the drawing strain per pass for an even-area reduction draft.

Figure 8:
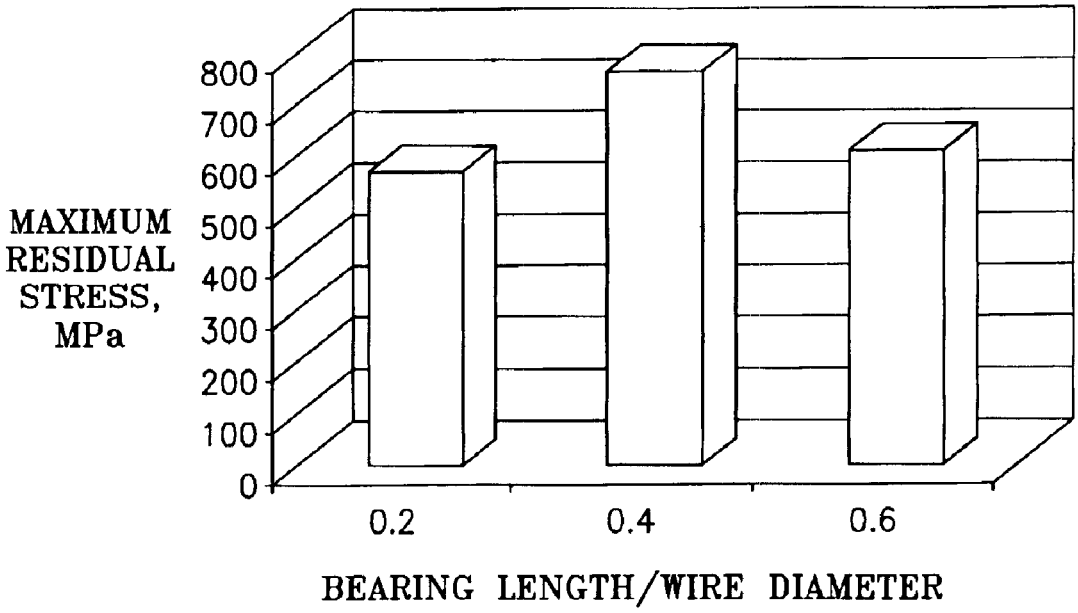
FIG. 8 illustrates a die applicable for drawing.
Figure 9:
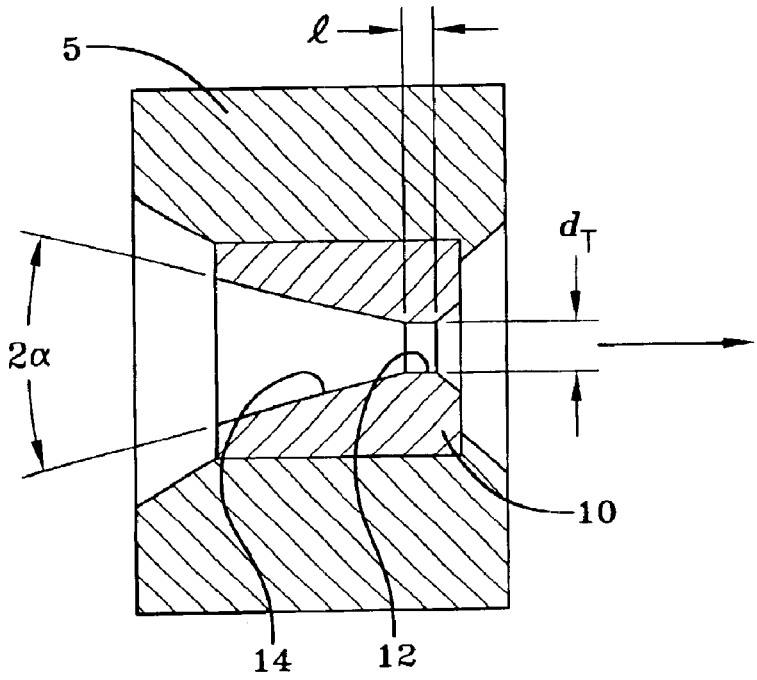
FIG. 9 is a comparison of the effect of die nib length on residual tensile strength.

The wire is preferably drawn through a die with an 8° approach angle. The die is illustrated in FIG. 8. The drawing die 5 has a nib 10 characterized by a bearing part 12 which has a bearing length 1. The die is also defined by an approach part 14 with an approach angle 2$\alpha$. The approach angle preferably is 8°. The length 1 of a bearing part 12 of the nib 2 is preferably either 10 to 30% of d1, d1 being the diameter of the nib 2, or 50 to 80% of d1. The bearing length 1 directly affects the maximum residual tensile stress at the surface of the wire drawn through the die. As seen in FIG. 9, the maximum residual tensile stress peaks when the bearing length 1 is about 40% of the diameter d1.

Again, similar to the direct draw, the wire is subject to a skin pass wherein the diameter of the wire is reduced by 4% for the purpose of reducing delamination.

By using the above die design and process and applying true strains of greater than 3.8, and preferably 3.9 to 4.5 as defined by $\epsilon_d=2\ \ln(d_o/d)$ where $d_o$ is the starting wire diameter and d is the final diameter filament of tensile strength greater than 3800 MPa at wire diameters 0.35 mm are achieved and wires with a tensile strengths greater than 4500 MPa at 0.20 mm are possible. For example, the true strain in the drawing of 1.65 mm wire to 0.20 mm diameter filament is 4.2.

As indicated, 8° dies are preferred, but marginal results can also be obtained by using 10° or 12° dies, or die drafts including dies with different angles. Regardless, in all cases, the skin pass is required.

Prior to the fine draw the wire may be treated for corrosion resistance and to improve wire drawability and the adhesion characteristics of the wire. For example, the wire may be coated with a thin layer of brass or brass alloys to improve adhesion of the steel wire to elastomers. Preferably brass is the coating of choice and the coating weight should be sufficient to remain on the filament after the drawing operation, also the brass should be predominately alpha brass in order to facilitate the drawability.

By employing the disclosed method of selecting a particular composition and processing the wire in the manner described above, the result is a wire having a tensile strength of at least 3800 MPa at wire diameters of 0.35 mm. The wire also exhibits a high level of ductility and outstanding fatigue resistance. Filaments made with the alloys and processing technique of this invention preferably have a tensile strength greater than 4200 MPa, and more preferably have a tensile strength of greater than 4500 MPa at 0.2 mm diameter.

Figure 10:
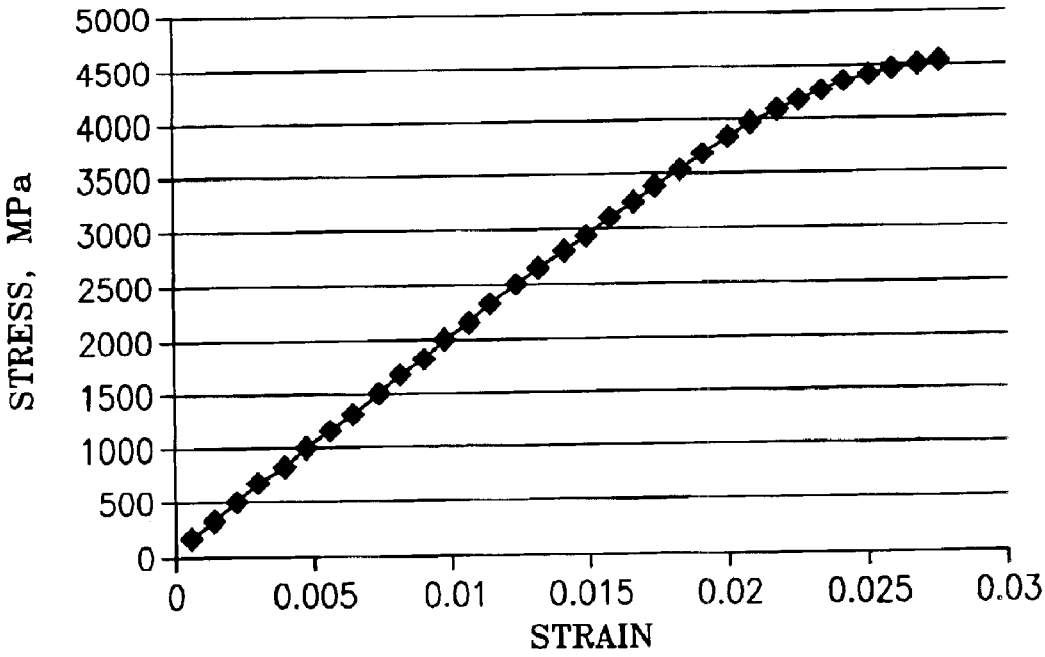
FIG. 10 is a stress-strain curve for a patented wire with a carbon content of 1.0%.

As an example, FIG. 10 shows a stress-strain curve for a 0.2 mm diameter filament produced according to the above process from a steel with the following composition: 1%C-0.5%Mn-0.4%Si-0.3%Cr-0.0016 ppmB. Ultimate tensile strength of the filament was approximately 4600 MPa, and tensile ductility was approximately 2.6%.

The resulting wire may be used in various products such as tires, hoses, conveyor belts, power transmission products, and other products reinforced by steel wire. In tires, the wire has particular application as filaments that are stranded together and then cabled to form tire cords. The cords, depending on the size, are useful in tread reinforcing plies such as belts, underlays, or overlays, and carcass plies. The wire may also be used to in forming tire beads. The wire, at the largest diameter, may be useful as a monofilament reinforcement in various parts of a tire.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. A process for forming a drawn wire, comprising a) casting and rolling of a steel to form a wire of an initial diameter, said steel comprising iron and the following components in percent by weight:

0.95%≦carbon≦1.3%, 0.2%≦chromium≦1.8%, 0.2%≦manganese≦0.8%

0.2%≦silicon≦1.2% cobalt≦2.2% niobium≦0.1%

0.0006 parts per million (ppm)≦boron≦0.0025 pm sulfur<0.006% phosphorus<0.010%;

b) rough drawing of the wire to reduce the diameter of the wire to an intermediate diameter;

c) patenting the wire to obtain a predominantly pearlitic microstructure with a small globular size having an elongation greater than 7.5%, with the predominantly pearlitic microstructure providing a tensile strength determined by the following equation:

$$Y_0=A_1[(1-C/C_c)(Y_f+K_f/((1-C/C_c)L)^{0.5}+(Y_c+K_c/(C/C_cL)^{0.5}C]+H\epsilon$$

where: $A_1$=a constant varying from 0.1 to 1 depending on the content of alloying elements, C=the carbon content of the steel, in %, $C_c$=the carbon content in cementite, in %, L=the thickness of ferrite lamellae, $Y_f$, $K_f$ and $Y_c$, $K_c$=Hall-Petch constants for ferrite and cementite, respectively, H=the strain hardening of the wire, and $\epsilon$=the total elongation of the wire;

d) brass plating and fine drawing the wire to reduce the wire to a final diameter of about 0.1 to about 0.4 mm with a true strain from 3.6 to 4.5 to obtain an ultimate tensile strength determined by the following equation:

$$Y=Y_0\ \exp(A_2\epsilon_d)$$

where $A_2$ is a constant from 0.2 to 0.5 and $\epsilon_d$ is total drawing strain wherein the wire has a tensile strength of at least 3800 MPa at a wire diameter of 0.35 mm.

2. The process according to claim 1 wherein, after patenting, the pearlitic microstructure have a maximum dimension of not more than 50 microns and an interlamellar spacing of less than 70 nm.

3. The process according to claim 1 wherein, after patenting, the wire has links of pro-eutectoid cementite surrounding the pearlitic microstructure, and the cementite links have a thickness of not more than 20 nm.

4. The process according to claim 1 wherein the rough drawing is a dry draw at a drawing rate of 4 to 14 m/sec.

5. The process according to claim 1 wherein after both the rough drawing and the fine drawing, a skin pass is performed on the wire.

6. A process for forming a drawn wire having a tensile strength of at least 3800 MPa, comprising a) casting a wire of steel to form a wire of an initial diameter, said steel comprising iron and the following components in percent by weight:

0.95%≦carbon≦1.3%, 0.2%≦chromium≦1.8%, 0.2%≦manganese≦0.8%

0.2%≦silicon≦1.2% cobalt≦2.2% niobium≦0.1%

0.0006 parts per million (ppm)≦boron≦0.0025 ppm;

b) non-linear tapered rough drawing of the wire to reduce the diameter of the wire to an intermediate diameter;

c) patenting the wire by first passing the wire through at least two different temperature zones, rapidly cooling the wire to a transformation temperature below the ideal transformation temperature, and then passing the wire through at least two different temperature zones wherein the wire is maintained at the transformation temperature; and d) brass plating and fine drawing the wire to reduce the wire to a final diameter of about 0.1 to about 0.4 mm.

7. The process according to claim 6 wherein the transformation temperature is about 20° to 80° C. below the ideal transformation temperature.

8. The process according to claim 6 wherein the rough drawing is a dry draw at a drawing rate of not more than 14 m/sec.

9. The process according to claim 6 wherein after both the rough drawing and the fine drawing, a skin pass is performed on the wire.

10. The process according to claim 6 wherein during patenting, the wire is cooled at a rate greater than 30° C./sec.

11. A wire made by the method of:

a) casting a wire of steel to form a wire of an initial diameter, said steel comprising iron and the following components in percent by weight:

0.95%≦carbon≦1.3%, 0.2%≦chromium≦1.8%, 0.2%≦manganese≦0.8%

0.2%≦silicon≦1.2% cobalt≦2.2% niobium≦0.1%

0.0006 parts per million (ppm)≦boron≦0.0025 ppm;

b) non-linear tapered rough drawing of the wire to reduce the diameter of the wire to an intermediate diameter;

c) patenting the wire by first passing the wire through at least two different temperature zones, rapidly cooling the wire to a transformation temperature below the ideal transformation temperature, and then passing the wire through at least two different temperature zones wherein the wire is maintained at the transformation temperature and wherein after patenting, the wire is comprised of pro-eutectiod cementite and pearlite and the network of pro-eutectoid cementite formed around the pearlite has a thickness of not more than 20 nm; and d) brass plating and fine drawing the wire to reduce the wire to a final diameter of about 0.1 to about 0.4 mm.

12. A wire according to claim 11 wherein the wire has a tensile strength greater than 3800 MPa at wire diameters of 0.2 to 0.35 mm.

13. A wire according to claim 11 wherein the wire has a tensile strength greater than 4500 MPa at a wire diameter of 0.2 mm.

14. A wire according to claim 11 wherein, after patenting, the wire has a fine pearlitic microstructure with interlamellar spacing of less than 60 nm.

15. A wire according to claim 11 wherein, after patenting, the wire has pearlite globular sizes of not more than 50 microns.

* * * * *